US005228312A

United States Patent [19]

Williams

[11] Patent Number: 5,228,312

[45] Date of Patent: Jul. 20, 1993

[54] METHOD AND APPARATUS FOR DISPENSING COLD BEVERAGES

[75] Inventor: Warren L. Williams, Grayson, Ga.

[73] Assignee: Wilshire Partners, Cleveland, Ohio

[21] Appl. No.: 716,072

[22] Filed: Jun. 17, 1991

[51] Int. Cl.[5] ..... B67D 5/62

[52] U.S. Cl. ..... 62/390; 62/437; 165/140; 222/1; 222/129.1; 222/146.6

[58] Field of Search ..... 222/129.1, 129.2, 129.3, 222/129.4, 146.6, 1; 62/390, 393, 396, 437; 165/14 D, 164

[56] References Cited

U.S. PATENT DOCUMENTS

| | | | |
|---|---|---|---|
| 2,082,975 | 6/1937 | Riesgo | 165/140 X |
| 2,247,388 | 7/1941 | Johnson et al. | 62/141 |
| 2,612,357 | 9/1952 | Parks | 261/11 |
| 3,979,024 | 9/1976 | Hoppe | 222/67 |
| 3,995,770 | 12/1976 | Schwitters | 222/56 |
| 4,203,186 | 5/1980 | Horner | 165/164 X |
| 4,535,917 | 8/1985 | Trewhella | 222/129.1 |
| 4,730,463 | 3/1988 | Stanfill | 222/146.6 X |
| 4,742,939 | 5/1988 | Galockin | 222/68 |
| 4,781,309 | 11/1988 | Vogel | 222/129.1 |
| 4,909,047 | 3/1990 | Koeneman et al. | 222/146.6 X |
| 4,969,576 | 11/1990 | Merrill et al. | 222/1 |

FOREIGN PATENT DOCUMENTS

| | | | |
|---|---|---|---|
| 1464648 | 9/1965 | France | 165/140 |
| 0064488 | 4/1983 | Japan | 165/164 |
| 938372 | 10/1963 | United Kingdom | 165/164 |
| 2194508 | 3/1988 | United Kingdom | 222/146.6 |

*Primary Examiner*—Andres Kashnikow
*Assistant Examiner*—Anthoula Pomrening
*Attorney, Agent, or Firm*—Body, Vickers & Daniels

[57] ABSTRACT

A relatively simple and compact beverage chilling device for providing uniform beverage temperatures in a post-mix beverage dispensing system regardless of the duration between usages. Chilled plain or carbonated water is circulated in an insulated conduit between a cooler and a dispensing tower with portions drawn off at selectively operated dispensing heads. Flavored syrups are supplied to the dispensing heads within the same insulated conduit. A thermal mass disposed in close proximity to the dispensing heads provides a heat transfer medium from the syrups to the chilled water.

17 Claims, 3 Drawing Sheets

FIG. 2
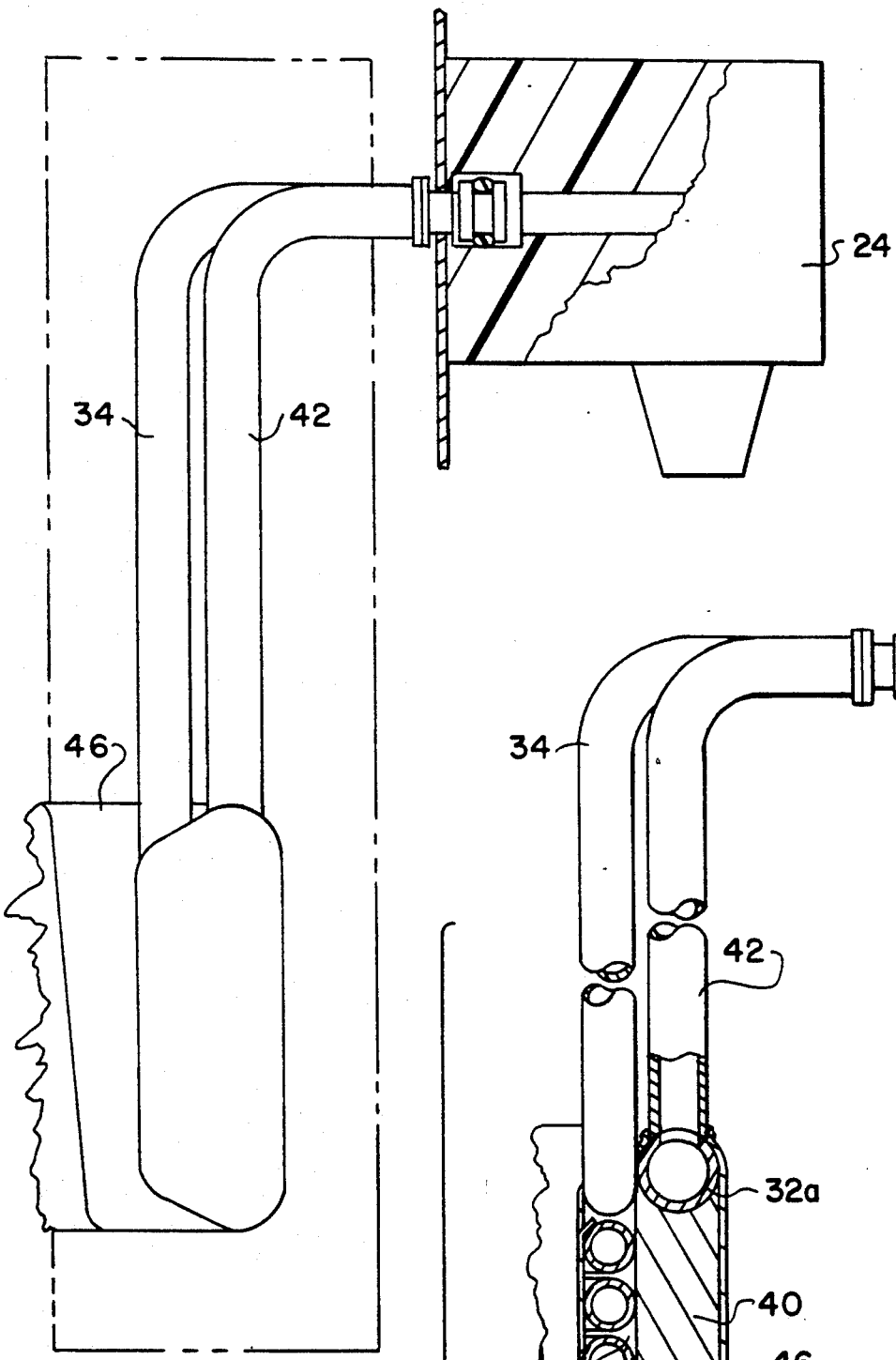
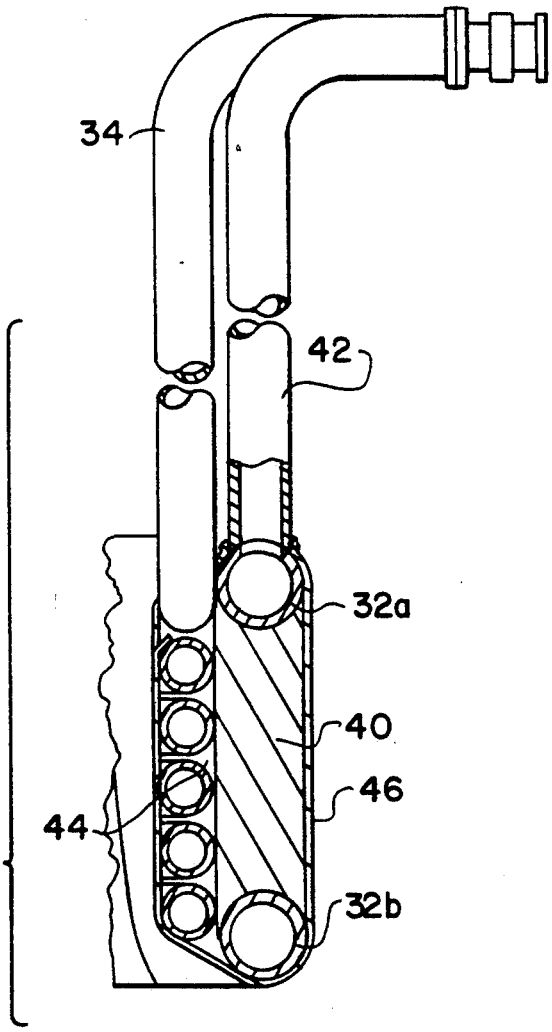
FIG. 4

METHOD AND APPARATUS FOR DISPENSING COLD BEVERAGES

BACKGROUND OF THE INVENTION

The present invention relates to liquid cooling systems, and more particularly to an improved method and apparatus for use in post-mix cold beverage dispensers in which measured quantities of fluids such as carbonated water and flavored syrups are selectively mixed and discharged through manually actuated dispensing heads.

Commercial installations of post-mix beverage dispensers typically include a "tower" with dispensing heads conveniently positioned on a foodservice counter for selectively mixing and discharging a variety of flavored syrups with plain or carbonated water. Due to the narrow front-to-back depth of the counter, severe design and space limitations are placed on the tower configuration which often preclude installation of a conventional refrigerating unit or cooler in the immediate vicinity of the dispensing heads. Consequently, the tower is installed on the counter with chilled water delivered through a long conduit from a remotely located cooler.

It is important for consistent performance of a cold beverage dispenser to deliver beverages at the same chill temperature each time. Under frequent usage, the temperature of the ingredients at the dispensing heads can be maintained fairly constant thus assuring a pleasing chilled beverage each time without excessive foaming. However, for so-called "casual" drinks where the dispenser may be idle for a prolonged period of time, usually 15 minutes or more, heat gain from the surroundings tends to increase the temperature of the stagnant ingredient near the dispensing heads. The temperature increase in the resulting beverage will vary depending on the quantity of quiescent water and syrup in the conduit and on the duration of exposure.

Several approaches for alleviating this problem are in use. One, such as disclosed in U.S. Pat. No. 4,969,576 to Merrill et al, periodically draws off an amount of warmed-up water near the dispensing heads allowing it to be replaced with chilled water from an ice-chilled cast aluminum plate. Another approach, disclosed in U.S. Pat. No. 4,781,309 to Vogel, recirculates the chilled water at a regulated temperature between a remote cooler and the dispensing heads in the tower. Both of these approaches provide an immediate discharge on demand of chilled water regardless of the length of conduit or the time elapsed since the dispenser was last used, but it does not compensate for increases in syrup temperature due to heat gain from external sources. Some installations, therefore, also chill the various flavored syrups by passing them through a cast aluminum heat exchanger with the chilled water, such as disclosed in U.S. Pat. No. 4,781,309 supra, or by running the syrup in lines along side the chilled water line within the insulated conduit.

After the syrup lines reach the beverage tower, however, they separate from the water line and continue to their respective dispensing heads for mixing and discharging with the water. When there is no demand, the quiescent syrup will warm up where the lines are separated resulting in a higher beverage temperature depending on the quantity of quiescent ingredients and the time lapse between usages.

SUMMARY OF THE INVENTION

Accordingly, it is an object of the present invention to provide a novel and improved post-mix chilled beverage dispensing system for delivering beverages at a consistent temperature regardless of the frequency of usage, in which syrups delivered to a remote beverage tower are chilled to the desired temperature in close proximity to the dispensing heads, in which temperature elevation of casual drinks due to quiescent syrup in the tower is minimized, and in which drawing off of one syrup does not adversely influence the temperature of adjacent syrups.

Another object of the invention is to provide a device for chilling liquid ingredients in a post-mixing beverage dispensing tower remotely located from a cooler, and which can be installed in a relatively shallow front-to-back housing of a beverage tower suitable for mounting on a foodservice counter or the like.

Still another object is to provide a method for dispensing a beverage at a consistent temperature regardless of usage frequency, and for chilling ingredients of a beverage in close proximity to the dispensing head.

Briefly, these and other objects and aspects of the invention are accomplished by a relatively simple and compact chilling device disposed within a beverage dispensing tower remotely located relative to a water and syrup cooler and recirculation unit. Chilled plain or carbonated water is circulated in a line within an insulated conduit between the unit and the tower with a portion of the water drawn off at selectively operated dispensing heads. Flavored syrups supplied through separate lines along side the water line and within the same insulated conduit, are selected for mixing in controlled amounts with the water at the dispensing heads. A thermal mass in close proximity to the dispensing heads is contiguous with the water and syrup lines for chilling the syrups immediately before being dispensed.

In one embodiment, the chilling device includes thermally conductive mass or bar, generally of rectangular cross section, disposed in the tower in close proximity to the dispensing heads. The chilled water line includes a U-shaped header intimately interfacing opposite sides of the bar fluid communication at spaced intervals with each immediately disposed dispensing head. The syrup lines separate from the insulated conduit and continue as a vertical stack intimately interfacing at least one of the other sides of the bar. The header and bar thereby act as a heat sink for the syrup lines in the immediate region of the dispensing heads. Thermally conductive tape wrapped around the outer surfaces of the syrup tubes, header and bar further assist in heat transfer from the syrup lines. Thermal insulators placed between individual syrup lines at the bar prevent each line from significantly influencing the temperature of the others as syrup is dispensed.

In another embodiment, the chilled water and syrups pass through conduits within a readily thermal conductive cast metal manifold located in the tower with pairs of water and syrup outlets from respective conduits immediately connected to the dispenser heads. In either embodiment any heat flowing into the thermal mass of the bars or manifold through the insulation or from the syrup is transferred to the chilled water. Temperature changes are minimized due to the thermal mass, relatively small amount of fluid is dispensed with each usage, and cooling is provided by the chilled water.

Other objects, advantages and novel features of the invention will become apparent from the following detailed description of the invention when considered in conjunction with the accompanying drawings.

BRIEF DESCRIPTION OF THE DRAWINGS

FIG. 2 is a side elevation view of a portion of one embodiment of a chilling device installed in a dispensing tower of FIG. 1;

FIG. 4 is a cross sectional view of the chilling device of FIG. 3 taken in a plane along the line 4—4 thereof;

DESCRIPTION OF THE PREFERRED EMBODIMENTS

Figure 1:
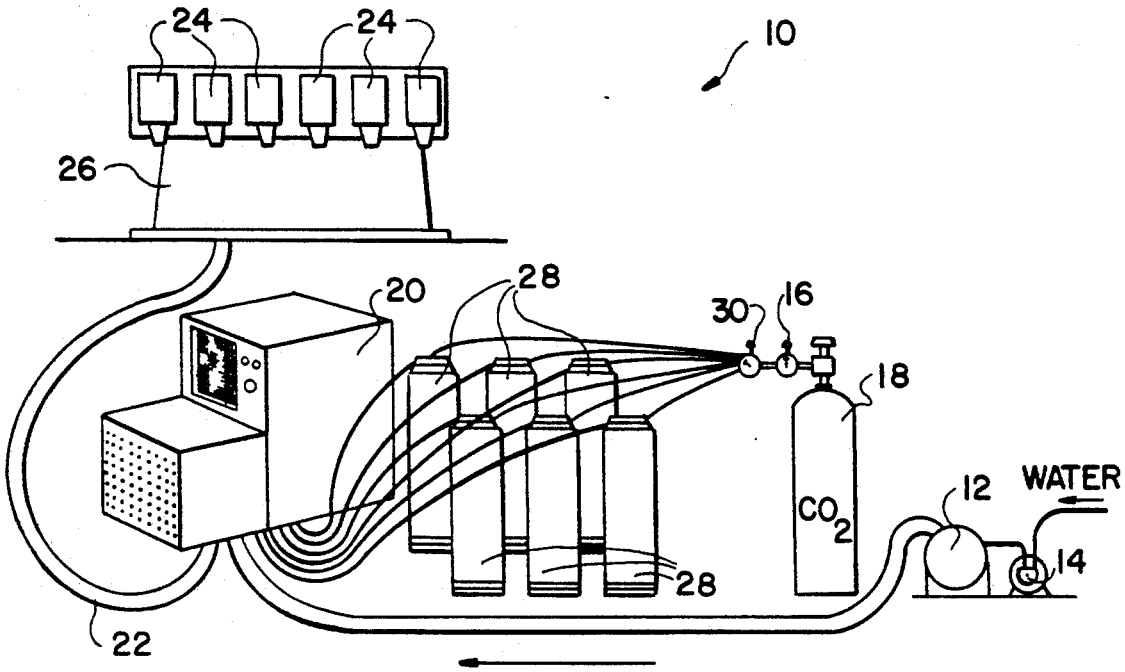
FIG. 1 is a schematic representation of a post-mix cold beverage dispensing system utilizing a beverage chilling apparatus according to the invention.

Referring now to the drawings wherein like reference characters designate like or corresponding parts throughout the several views, FIG. 1 illustrates a typical arrangement for dispensing post-mixed, chilled carbonated beverages. Water is supplied under pressure to a carbonator tank 12 through a motor-driven pump 14; and pressurized carbon dioxide is delivered through a regulator 16 from a tank 18. The amount of water supplied to tank 12 is regulated according to the fluid level. Carbonated water from tank 12 passes through a cooler and recirculation unit 20 and an insulated conduit 22 to a horizontal row of dispensing heads 24 mounted in counter-top beverage tower 26 in a location convenient to the user, usually remotely from unit 20. Various flavored syrups, maintained under pressure in containers 28 by $CO_2$ supplied from tank 18 through regulators 16 and 30, are also chilled in unit 20 and delivered to dispensing heads 24 through the same insulated conduit 22. By manually initiated actuators, not shown, carbonated water and syrup are mixed and discharged as a cold beverage at heads 24.

Figure 3:
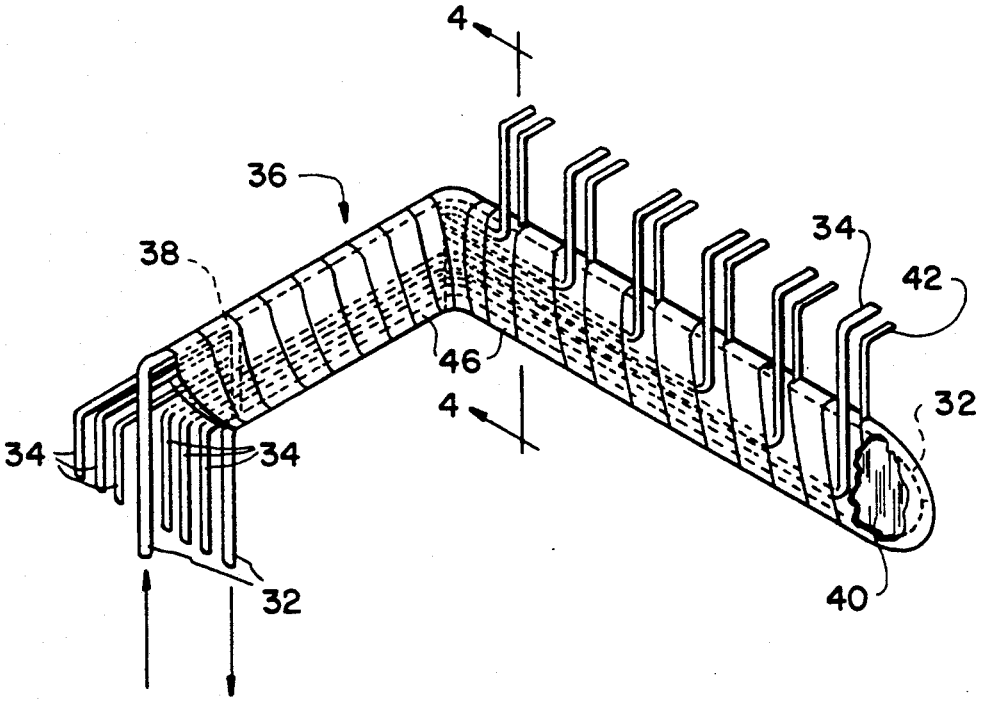
FIG. 3 is an isometric rear view of the chilling device of FIG. 2.

Referring to FIGS. 2, 3 and 4, the chilled carbonated water and syrup lines separate from insulated conduit 22 and continue as water tubes 32 and syrup tubes 34 to a chilling device 36 located in immediate proximity to dispensing heads 24. Device 36 includes a chill bar 38 having vertically disposed flat sides and of a material selected for its ability to absorb and transfer thermal energy with ease such as aluminum. Where space permits, another bar 40 may be arranged in an L-shape with bar 40 for supplemental chilling. Bar 38 is closely aligned lengthwise along the row of dispensing heads. Water tube 32 is generally U-shaped to define a header section **32*a* and a return section 32*b*, each respectively contiguous with top and bottom surfaces of bars 38 and 40. The section 32*b* returns through conduit 22 to unit 20 for recirculating carbonated water which has not been drawn off by dispensing heads 24. In a further embodiment, there is provided an apparatus for dispensing a fluid mixture at a substantially uniform temperature, comprising, in combination; a fluid mixture dispensing means; a first means for delivering a substantially uniform temperature fluid to said dispensing means; a second means for conducting a variable temperature fluid to said dispensing means; and a thermal mass mean disposed in immediate proximity to said dispensing means and secured in heat exchanged relation to said first and second means. Thermistors, not shown, are attached to header section 32*a* for regulating recirculation at unit 20. Short risers 42 respectively communicate at spaced intervals along the length of chill bar 40 between header section 32*a* and dispensing heads 24. The portions of syrup tubes 34 separated from conduit 22 divide in approximately equal numbers to contact opposite sides of bar 38 in heat exchange relationship, recombine to contact the rear side of bar 40, and fluidly connect to dispensing heads 24**.

Adjacent syrup tubes 34 do not significantly influence one another as syrup is drawn off and warm syrup takes its place because chill bars 38 and 40 maintain interfacing contact with all syrup and water tubes 32 and 34 and immediately cool the warm syrup. In addition, thermal insulating spacers 44 inhibit heat transfer between adjacent syrup tubes 34. The vertical stacking arrangement of syrup tubes 34 along the surfaces of chill bars 38 and 40 allows the thermally conductive tape 46 to be wrapped around the assembly of chill bars 38 and 40 and water and syrup tubes 32 and 34 thereby providing another heat transfer path between adjacent components. Tape 46 may be wrapped in the same manner as tape on the grip of a baseball bat.

Thus, it is seen that a slim vertical stack-up of tubes yields a very shallow front-to-back depth behind the dispensing heads. This feature allows the tower depth to be minimized while improving the availability of a chilled casual drink. That is, by keeping the fluid lines short between header **32*a* and dispensing heads 24**, the casual drink temperature very closely approximates a steady flow temperature.

Figure 5:
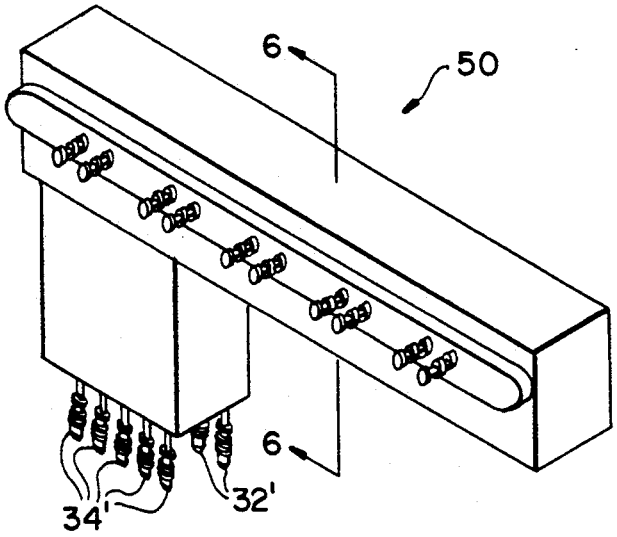
FIG. 5 illustrates an alternate embodiment of a beverage chilling device suitable for installing in the dispensing tower of FIG. 1.
Figure 6:
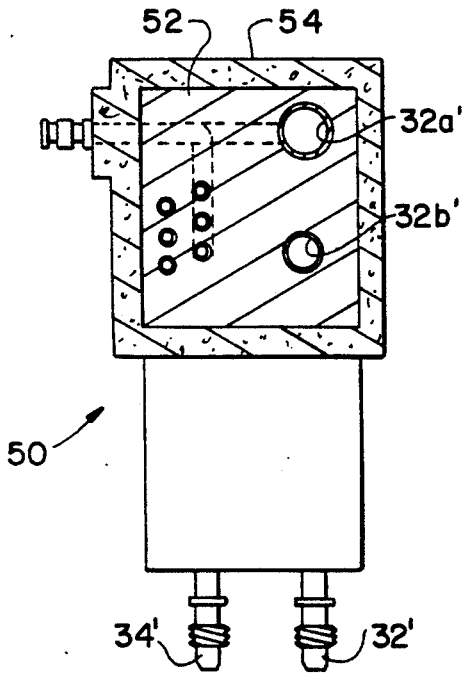
FIG. 6 is a view partially in cross section of the chilling device of FIG. 5 taken in a plane along the line 6—6 thereof.
Figure 7:
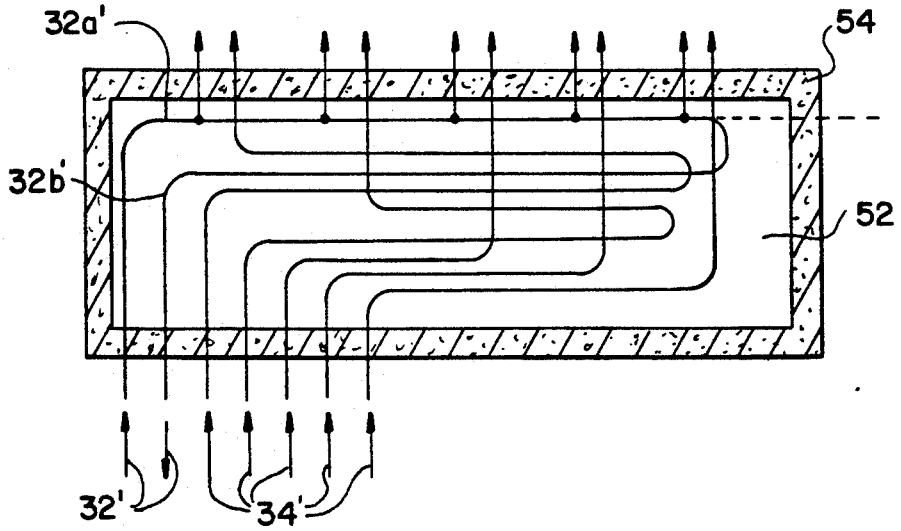
FIG. 7 is a schematic representation of the fluid lines within the chilling device of FIG. 5.

The embodiment of FIGS. 5–7, the chilling device comprises a manifold 50 mounted within beverage tower 26 immediately behind dispensing heads 24 for chilling the syrup. It includes a cast aluminum plate 52 with cast-in-place header and return sections **32*a*' and 32*b*', and syrup tubes 34' which are connected respectively to the syrup and recirculating water lines in insulated conduit 22. Syrup tubes 34' are circuitously formed within plate 52 in a roundabout manner as illustrated in FIG. 7 to provide maximum surface exposure for heat transfer. Plate 52 is completely insulated by thermal jacket 54 to minimize the effects of ambient temperature. Thus, any heat flowing to manifold 50 from the syrup or water is absorbed by plate 52 and transferred to water line 32'. Syrup temperature changes are thereby minimized when the product is dispensed due to the relatively large thermal mass of plate 52** and the relatively small amount of unchilled fluid dispensed.

Many modifications and variations of the present invention are possible in view of the above disclosure. It is therefore to be understood, that within the scope of the appended claims, the invention may be practiced otherwise than as specifically described.

I claim:

1. In a post-mix beverage dispenser having a cooler adapted to chill fluids, dispensing heads horizontally aligned along the front of a beverage tower spaced from said cooler, a water supply line receiving chilled water from the cooler connected to the heads, a water recirculating line connected between the heads and the cooler, and syrup supply lines connected between the dispensing heads and the cooler and separate sources of syrup, the improvement comprising:

a header juxtaposed immediately behind the dispensing heads, said header being fluidly connected between the water supply line and the water recirculating line, said header being further connected at spaced outlets to each of the dispensing heads; and a thermal mass including a first bar with opposed vertical sides, said first bar being contiguous with said header and the syrup lines being contiguous to said bar, said bar being adapted for storing heat from the syrup lines and for transferring stored heat to said header;

whereby the temperature of dispensed beverages maintained constant with variations in demand.

2. A beverage dispenser according to claim 1 wherein:

said header includes a first section defining a generally U-shaped tube contiguous along the top and bottom surfaces of said first bar; and the syrup lines are contiguous to at least one of the sides of said bar.

3. A beverage dispenser according to claim 2 wherein: each of said syrup lines is stacked in a plane parallel to said one side of said first bar.

4. A beverage dispenser according to claim 2 wherein:

said thermal mass includes a second bar with opposed vertical sides, and aligned in transverse relationship to said first bar;

said header includes a second section of parallel tubes contiguous along the top and bottom surfaces of said second bar; and the syrup lines are contiguous to both sides of said second bar.

5. A beverage dispenser according to claim 1 wherein:

the water supply and water recirculating lines, and the syrup lines, are mutually contiguous along their lengths within a common insulator conduit.

6. A beverage dispenser according to claim 1 wherein:

said thermal mass comprises an elongated casting with said header and syrup lines disposed therewithin.

7. A beverage dispensing system for providing a mixed beverage of uniform temperature with variations in demand, comprising, in combination:

a water supply line connected to a water cooler;

a housing remote from said cooler containing beverage dispensing heads;

a recirculating water line connected between said dispensing heads and said cooler;

syrup supply lines connected to said dispensing heads;

heat transfer means mounted in immediate proximity to said dispensing heads and contiguous with said syrup supply lines for removing heat from said syrup supply lines and storing said heat; and header means in fluid communication with said recirculating water line and contiguous with said heat transfer means for transferring heat from said heat transfer means to said header means.

8. Apparatus for dispensing a fluid mixture at a substantially uniform temperature, comprising, in combination;

fluid mixture dispensing means for discharging a beverage;

first means for delivering a substantially uniform temperature fluid to said dispensing means;

second means for conducting a variable temperature fluid to said dispensing means; and thermal mass means disposed in immediate proximity to said dispensing means, said thermal mass means including an elongated member of generally rectangular cross section and secured in heat-exchange relation to said first and second means for transferring heat between said first and second means, said fluid from said first and second means discharged through said dispensing means to form said beverage at some desired temperature.

9. Apparatus according to claim 8 wherein:

said apparatus includes a fluid chiller spaced from said dispensing means and said first means recirculates at least a portion of the uniform temperature fluid.

10. A carbonated beverage dispensing apparatus, comprising, in combination:

a cooler for supplying and recirculating carbonated water at a substantially uniform temperature;

a thermal mass remotely disposed relative to said cooler for storing and transferring heat energy;

header means in heat exchange relation to said thermal mass for receiving and returning carbonated water from said cooler, said recirculating carbonated water absorbing heat from said header means;

tube means in heat exchange relation to said thermal mass for receiving a variable temperature syrup; and dispensing means disposed in immediate proximity to said thermal mass for receiving said carbonated water and syrup from said header means and said tube means, respectively.

11. A method for dispensing a mixed beverage at a substantially uniform chill temperature under conditions of varying usage, comprising the steps of:

chilling water to a uniform temperature at a first location;

recirculating said chilled water through a heat exchanger located in immediate proximity to a dispensing head at a second location and back to said first location;

passing a plurality of syrups through the heat exchanger for chilling the syrups and heating said heat exchanger;

and mixing a selected one of the chilled syrups with a portion of said chilled water for discharge at the dispensing head.

12. In a post-mix beverage dispenser having dispensing heads horizontally aligned along the front of a beverage tower, a water supply line connected to the heads, a water recirculating line connected between the heads and the cooler, and syrup supply lines connected between the dispensing heads and separate sources of syrup, the improvement comprising:

a header juxtaposed immediately behind the dispensing heads, said header being fluidly connected between the water supply line and the water recirculating line, said header being further connected at spaced outlets to each of the dispensing heads;

a thermal mass contiguous with said header and the syrup lines for storing head from the syrup lines and for transferring stored head to said header;

whereby the temperature of dispensed beverages is maintained constant with variations in demand;

said thermal mass includes a first bar with opposed vertical sides;

said header includes a first section defining a generally U-shaped tube contiguous along the top and bottom surfaces of said first bar; and the syrup lines are contiguous to one of the sides of said bar.

13. A beverage dispenser according to claim 12, wherein:

each of said syrup lines is stacked in a plane parallel to said one side of said first bar.

14. A beverage dispenser according to claim 12 wherein:

said thermal mass includes a second bar with opposed vertical sides, and aligned normal to said first bar;

said header includes a second section of parallel tubes contiguous along the top and bottom surfaces of said second bar; and the syrup lines are contiguous to both sides of said second bar.

15. A beverage dispensing system for providing a mixed beverage of uniform temperature with variations in demand, comprising, in combination:

a water supply line connected to a water cooler;

a housing remote from said cooler containing beverage dispensing heads;

a recirculating water line connected between said dispensing heads and said cooler;

syrup supply lines connected to said dispensing heads;

heat transfer means mounted in immediate proximity to said dispensing heads and contiguous with said syrup supply lines for removing heat from said syrup supply lines; and header means in fluid communication with said recirculating water line and contiguous with said heat transfer means for transferring heat from said heat transfer means to said header means;

said heat transfer means includes a thermal mass of rectangular cross section with planar sides;

said header means is contiguous with one of said planar sides; and each of said supply lines is circuitously formed in a single plane adjacent one of said sides.

16. A beverage dispensing system according to claim 15 wherein:

said water supply and water recirculating lines and syrup lines are in mutually contiguous contact within a common insulator conduit.

17. Apparatus for dispensing a fluid mixture at a substantially uniform temperature, comprising, in combination;

fluid mixture dispensing means for discharging a beverage;

first means for delivering a substantially uniform temperature fluid to said dispensing means;

second means for conducting a variable temperature fluid to said dispensing means;

thermal mass means disposed in immediate proximity to said dispensing means and secured in heat-exchange relation to said first and second means for transferring heat between said first and second means, said fluid from said first and second means discharged through said dispensing means to form said beverage at some desired temperature;

said thermal mass means includes an elongated member of rectangular cross section;

said first means includes an U-shaped header contiguously secured to opposed sides of said elongated member; and said second means is contiguously secured to opposed sides of said elongated member.

* * * * *